United States Patent [19]

Gauchard

[11] 3,938,287

[45] Feb. 17, 1976

[54] MAUSOLEUM

[76] Inventor: Fernand Gauchard, Parc du Beau, Santeny (Val de Marne), France

[22] Filed: Dec. 19, 1974

[21] Appl. No.: 534,449

[30] Foreign Application Priority Data

Dec. 28, 1973 France ..... 73.46933

[52] U.S. Cl. ..... 52/134; 27/11; 27/1; 52/131

[51] Int. Cl.[2] ..... E04H 13/00

[58] Field of Search ..... 52/136, 134, 128, 133, 52/138, 139, 142, 131, 132, 135, 79, 137; 27/11, 1, 19; 137/240, 360, 565, 266

[56] References Cited

UNITED STATES PATENTS

| | | | |
|---|---|---|---|
| 1,013,963 | 1/1912 | Smith | 137/565 |
| 1,050,773 | 1/1913 | Holmes | 52/136 |
| 1,087,448 | 2/1914 | Holway | 52/131 |
| 1,183,323 | 5/1916 | Sievert | 52/134 |
| 1,244,109 | 10/1917 | Lovell | 52/132 |
| 1,641,123 | 8/1927 | Cullinan | 52/132 |
| 1,815,883 | 7/1931 | Davis | 52/137 |
| 2,783,523 | 3/1957 | Halley | 52/136 |
| 3,295,271 | 1/1967 | Dorris | 52/137 |
| 3,542,059 | 11/1970 | Blanchard | 52/131 |
| 3,564,796 | 2/1971 | Smith | 52/131 |

*Primary Examiner*—Ernest R. Purser
*Assistant Examiner*—Robert Farber
*Attorney, Agent, or Firm*—Young & Thompson

[57] ABSTRACT

A mausoleum comprises a plurality of prefabricated concreté modules each comprising a plurality of niches for individual coffins, each niche having a closed end and an open end and being defined between horizontal and vertical walls. Tubing is embedded in the horizontal and vertical walls, the tubing having risers at the open ends of the niches for connection to individual coffins. The horizontal tubes are inclined at one end where they connect to vertical tubes for removal of gases, the horizontal tubes connecting with other vertical tubes at their other ends for the removal of liquids. The liquids and gases thus collected and removed are treated prior to discharge.

5 Claims, 3 Drawing Figures

Figure 3:
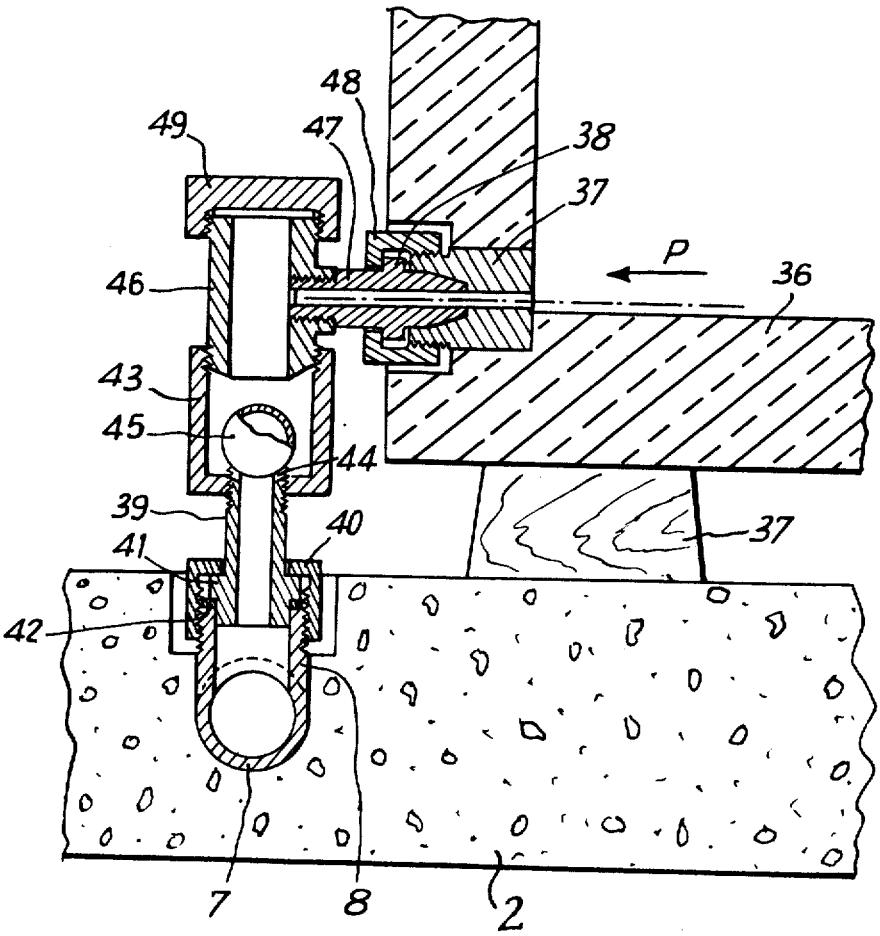

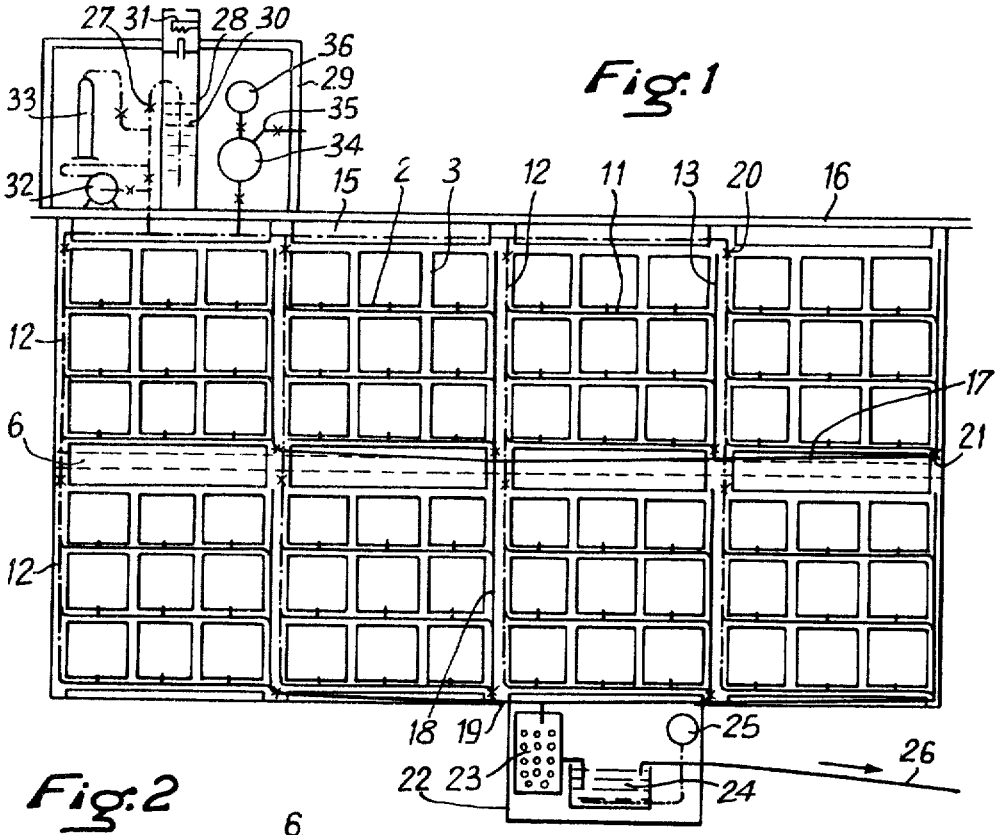
Fig. 1
Fig. 2
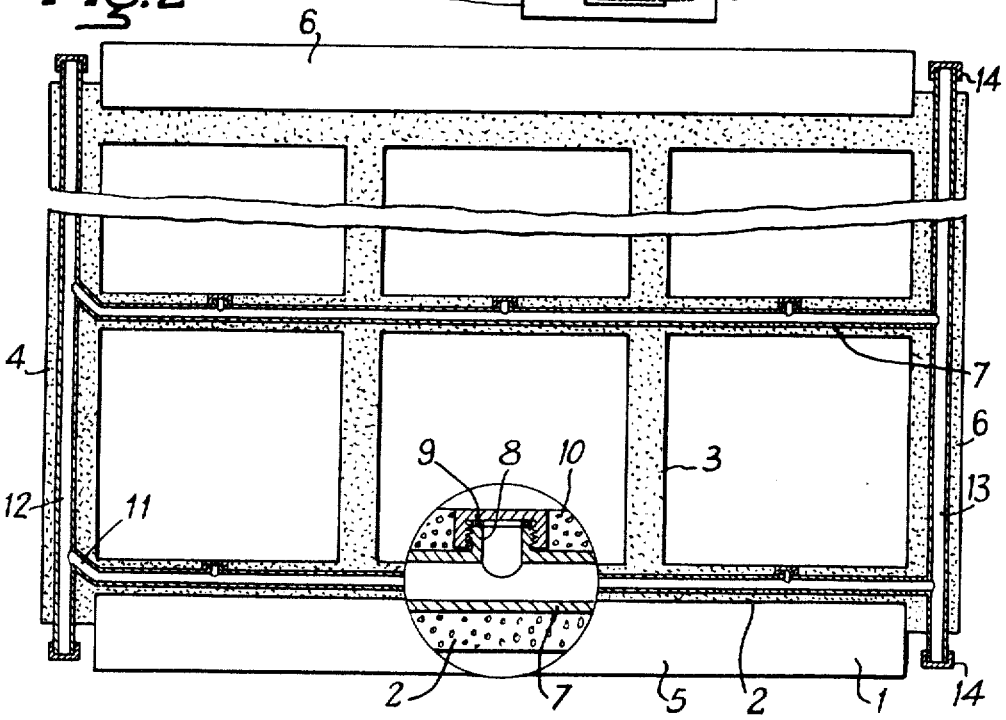

MAUSOLEUM

The present invention relates to mausolea, more particularly of the type for receiving coffins containing unembalmed corpses. Such coffins may for example be of the type disclosed in my earlier U.S. patent application Ser. No. 527,294, filed Nov. 26, 1974 and my U.S. Pat. No. 3,525,132. Mausolea known in this art are subterranean, above ground or partly subterranean and partly above ground and ordinarily provide only individual niches designed to receive coffins. However, it is sometimes necessary to evacuate physiological liquids and gases from sealed coffins. Existing mausolea are not designed to do this, it being possible only to provide a network of gutters for the constructions known thus far, which would be unsuitable because it would expose the physiological liquids and gases to the atmosphere. Known mausolea, therefore, are useful only with sealed coffins which are especially designed to prevent decomposition of the corpse or which contain embalmed corpses. However, it is undesirable to require that all coffins lodged in a given mausoleum conform to this latter standard.

Accordingly, it is an object of the present invention to provide a mausoleum that provides for the disposal of physiological liquids and gases emanating from individual coffins.

Another object of the present invention is the provision of such a mausoleum which can be comprised of prefabricated modules.

Still another object of the present invention is the provision of such a mausoleum with means to collect and treat the physiological liquids and gases to render them innocuous.

A still further object of the present invention is the provision of such a mausoleum with a network of conduits and means to cleanse the network by flushing with a cleaning liquid.

Still another object of the present invention is the provision of such a mausoleum with a network of conduits for the reception and separation and treatment and discharge of physiological liquids and gases, with easy connection for individual coffins to the network.

Finally, it is an object of the present invention to provide such a mausoleum, which will be relatively simple and inexpensive to manufacture, construct, clean, maintain and repair.

Other objects, features and advantages of the present invention will become apparent from a consideration of the following description, taken in connection with the accompanying drawings, in which:

FIG. 1 is a somewhat schematic elevational view of a two-story mausoleum according to the present invention;

FIG. 2 is an enlarged fragmentary view of a portion of FIG. 1 showing a prefabricated unit for the construction of a mausoleum according to the present invention, with an enlarged fragment of FIG. 2 showing a connection to an individual coffin; and FIG. 3 is an enlarged fragmentary cross-section view of the portion that is enlarged within the circle of FIG. 2, with a fragment of a coffin connected thereto.

Referring now to the drawings in greater detail, it will be recognized that the mausoleum of the present invention is modular, one of the modules being shown in FIG. 2 and an assembly of the modules being shown in FIG. 1. The assembly of FIG. 1 thus comprises eight modules each having 9 niches on each side thereof for a total of 18 per module, for a total of 144 niches for the mausoleum shown.

As is best seen in FIG. 2, each module 1 is of cast concrete comprising horizontal walls 2 and vertical walls 3 delimiting niches, as well as outer vertical side walls 4 and reinforcing beams 5 and 6 at the bottom and top, respectively, of the module, these beams being interconnectible with conventional fasteners (not shown) to assemble the modules into a unified mausoleum.

The horizontal walls 2 form the floors of the niches and adjacent the front, that is, the open end, of the niches, horizontal tubes 7 are cast in the concrete. Midway of the width of each niche is an upstanding connection 8 to each tube 7 which is closed by a screw threaded cap 9 which is flush with the surrounding concrete so as to facilitate the molding of the modules and their release from their mold. Each cap is first covered with a layer 10 of material that prevents the adhesion of the concrete to the cap, so as to facilitate the screwing and unscrewing of the cap from the connection 8.

At one end, each tube 7 is inclined upwardly at 11, to prevent the exit of liquid from this end of the tube and to ensure that liquid will leave through the other end of the tube. The tubes 7 could alternatively be inclined throughout their length but this would require that the thickness of the walls 2 be greater. At their inclined end, the tubes are connected to a vertical tube 12 molded in the side wall 4, and, at their other end, the tubes are connected to a vertical tube 13 molded in the opposite side wall. These tubes 12 and 13 are closed by caps 14 which are externally accessible even after the assembly of the modules so as to permit interconnection of the tubes and the interposition of valves to be described hereinafter.

The liquids and gases that escape from the coffins through connecting means that will be described hereinafter, enter the tubes 7. The gases are evacuated through the tube 12 while the liquids flow toward the tube 13.

As will be seen from FIG. 1, the tubes 12 are shown in dash dotted lines and are seen to be connected to a manifold 15 which, in the illustrated embodiment, is located between the upper wall of the upper modules and a slab 16 which forms the top of the mausoleum.

The tubes 13 of the vertically superposed layers of modules are interconnected and provide gravity flow to an inclined collector which empties into a vertical collector 18 constituted by one of the tubes 13, the assembly of tubes 13 of the lowermost layer of modules being connected to a collector 19.

To permit the washing procedure which will be described hereinafter, valves 20 are provided for tubes 12 and valves 21 are provided for tubes 13, at various places in the fluid circuit as shown for example in FIG. 1.

Referring also to FIG. 1, it will be seen that the collector 19 empties into collection means 22 in which is disposed a filter 23 which may under certain circumstances be constituted by a septic tank or pit, and a tank 24 into which filter or tank 23 empties. The material in tank 24 may be aerated or otherwise treated with gas from a gas supply 25, the gas bubbling through the liquid in tank 24. The liquid thus purified by filtration or the like plus gas treatment, is then evacuated through conduit 26 and sewered.

The gases which are conveyed upwardly by the tubing flow under control of various valves such as 27, into a bubbling tank 28 provided in an equipment room 29, in which the gas bubbles through a body of liquid 30 and is then catalytically combusted at 31 and vented. The greater part of this collected gas will be light hydrocarbons and so it will burn. A vacuum pump 32 may also be provided for placing the gas conduits and the interiors of the coffins in the mausoleum under vacuum. By appropriate arrangement of the valve 27, it is also possible to introduce into the gas circuit and the coffins any desired gas 33 such as reducing or oxidizing or disinfecting gas.

To permit the washing of the installation, and particularly of the tubing, a reservoir 34 is provided in which is admixed water from a conduit 35 and a disinfectant liquid from a reservoir 36 If the filter or the like 23 is in fact a septic tank, then the disinfected liquid is chosen so as not to interrupt its function. The mixture in reservoir 34 then may be sent through the tubing of the mausoleum by gas evacuation tubing 12. The washing and disinfection treatment is preferably effectuated module-wise; and to this end, the valves 20 can for example be closed so as to direct liquid to a single module, the valve 21 of this module being closed so that all of the tubing of the module fills with disinfectant solution, after which the valve 21 is opened to empty the tubes of the modules. It is also possible to calibrate the tubing so as to ensure a suitable distribution of the liquid flow among the various modules.

In order to prevent the wash liquid from entering the coffins, the connection of the coffin to the conduit system is preferably effectuated as shown in FIG. 3. The coffin 36 is placed in the niche on supports 37 so as to be slightly inclined in the direction P. The coffin has, in its vertical wall at the bottom center thereof, a coupling 37 which may initially be closed by a cap (not shown) on a fitting 38.

The coupling to the drain system comprises a fitting 39 with a screw threaded collar 40 which is screw-threadedly connected to the connection 8 of the tube 7 in place of the cap 9. Collar 40 thus forms a joint, with flange 41 and seal 42, which is fluidtight. At its upper end, the fitting 39 is screw-threadedly connected to the lower end of a ball valve chamber 43, the upper end of fitting 39 extending into this chamber and providing a spherical seat transected by a plurality of slots 44, there being a ball 45 resting on that seat. These slots 44 permit the passage of liquids and gases despite the presence of ball 45 on the seat. The ball 45 is hollow and is designed to float on aqueous liquids.

A T connection 46 is screw threaded through the top of chamber 43 and has a lateral screw threaded connection with a nipple 47 on fitting 38. A collar 48 is screw threaded on coupling 37 and bears on a flange on fitting 38.

Fitting 38, in turn, has a conical portion that is received within a conical recess in coupling 37; and a collar 48 in screw-threaded engagement with coupling 37 bears on a flange of fitting 38 to mate the complementary conical portions of 37 and 38. A frangible seal (not shown) carried by coupling 37 closes the passageway through coupling 37 to prevent the escape of gas and liquid from the coffin until fitting 38 is fully seated in the FIG. 3 position by rotation of collar 48. Connection 46 is closed at its upper end by a screw threaded cap 49.

With the parts in the assembled condition of FIG. 3, it will be seen that the liquids which flow out of the coffin as well as the gases will flow into the T connection 46. The liquids will pass into chamber 43 and through the slots 44 to the tubes 7 for treatment and discharge as previously recited. However, during flushing or washing of the system, when there is an excess of liquid, the ball 45 will float on this excess liquid and close the T connection 46 by sealing engagement with the lower end thereof, thereby to prevent liquids from backing up into the coffins.

In case of an accident involving an individual coffin, for example the plugging up of a drain passageway, it is possible to remove the cap 49 and to introduce into the T connection 46 a member that bears against ball 45 and at the same time interrupts the communication between connection 46 and chamber 43 while leaving open the communication through 37 and 38. The passageway to the coffin can then be unplugged by a small injection of gas or liquid and also the corpse within the coffin can be treated in this manner by disinfectant and/or reducing gases or liquids.

From a consideration of the foregoing disclosure, therefore, it will be evident that the initially recited objects of the present invention have been achieved.

Although the present invention has been described and illustrated in connection with a preferred embodiment, it is to be understood that modifications and variations may be resorted to without departing from the spirit of the invention, as those skilled in this art will readily understand. Such modifications and variations are considered to be within the purview and scope of the present invention as defined by the appended claims.

Having described my invention, I claim:

1. A mausoleum comprising a plurality of prefabricated concrete modules each comprising a plurality of vaults separated by horizontal bottom walls and vertical side walls, coffins in at least some of said vaults, vertical and horizontal tubes embedded in said vertical and horizontal walls, respectively, risers connected to the tubes embedded in the horizontal bottom walls and opening in each vault, coupling means connected between a said riser and a coffin in the corresponding vault, a valve in said coupling means allowing the passage of liquid from the coffin to within the riser and of gases in both directions but preventing overflowing of liquids from the riser into the coffin, said tubes in said horizontal walls being inclined upwardly toward and connecting with said vertical tubes at one end of said horizontal tubes thereby to prevent the flow of liquid from said horizontal tubes into said vertical tubes at said one end, and means for removing gas from the vertical tubes at said one end of said horizontal tubes, said horizontal tubes communicating with other said vertical tubes at the other ends of said horizontal tubes, and means for removing liquid from said other vertical tubes.

2. A mausoleum as claimed in claim 1, and means for introducing a wash liquid into said tubes.

3. A mausoleum as claimed in claim 1, and vacuum pump means connected to said tubes for placing said tubes under negative pressure.

4. A mausoleum as claimed in claim 1, certain of said vaults having no coffin therein, and a removable cap on the riser associated with each said certain vault.

5. A mausoleum as claimed in claim 1, each said vault having an open end and a closed end, said risers being disposed adjacent the center of the open end of the vaults.

* * * * *